United States Patent [19]

Djeddah

[11] 4,136,259

[45] Jan. 23, 1979

[54] IGNITING ELECTRODES AND METHOD FOR MAKING SAME

[76] Inventor: Jacques L. Djeddah, 4, Avenue Jules Guesde, 92330, Sceaux, France

[21] Appl. No.: 732,883

[22] Filed: Oct. 15, 1976

[30] Foreign Application Priority Data

Oct. 21, 1975 [FR] France ..... 75 32120

[51] Int. Cl.[2] ..... H01T 13/34; H01T 13/36; F23Q 3/00

[52] U.S. Cl. ..... 174/152 S; 29/25.12; 29/432; 29/525; 29/592 R; 313/145; 339/221 R

[58] Field of Search ..... 219/260, 270; 361/253; 60/39.82 S; 431/132, 258, 262, 264, 265, 266; 174/138 R, 138 S, 152 R, 152 S; 29/25.12, 432, 525, 592; 123/169 CB, 169 EL, 169 E; 313/143, 145; 339/213 R, 213 S, 217 SP, 220 A, 220 T, 221 R, 221 M

[56] References Cited

U.S. PATENT DOCUMENTS

| | | | |
|---|---|---|---|
| 1,101,137 | 6/1914 | Melanson | 174/152 S |
| 1,263,038 | 4/1918 | Champion | 174/152 S |
| 1,814,997 | 7/1931 | Wittner | 313/145 X |
| 2,464,908 | 3/1949 | Volkmann | 29/525 X |
| 2,537,061 | 1/1951 | Kohring | 339/221 R X |

*Primary Examiner*—Laramie E. Askin

*Attorney, Agent, or Firm*—Scully, Scott, Murphy & Presser

[57] ABSTRACT

A method of manufacturing an igniting electrode for a burner in which an insulating ceramic body has a longitudinal bore therethrough with projections or teeth provided over at least part of its length, and an electrically conducting metal stem, of complementary shape to the longitudinal bore absent the projections or teeth, is forced into the bore so that the projections or teeth make an imprint in the surface of the metal stem as it is being inserted into the bore.

13 Claims, 9 Drawing Figures

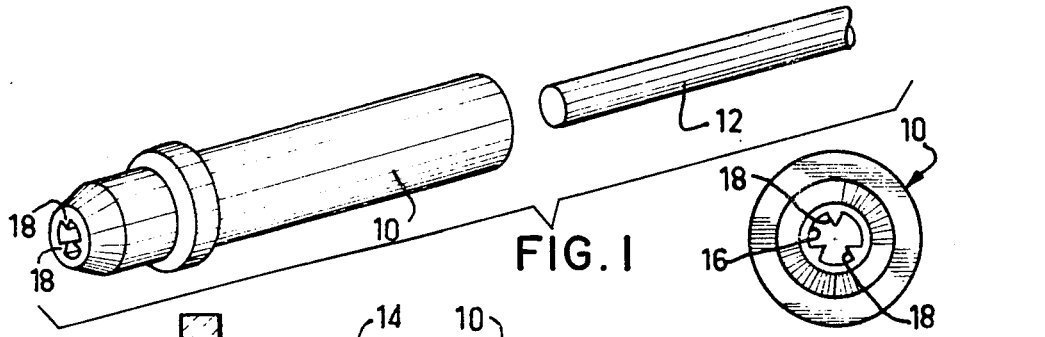
FIG. 1
FIG.1A
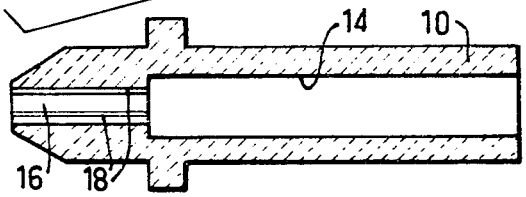
FIG.2
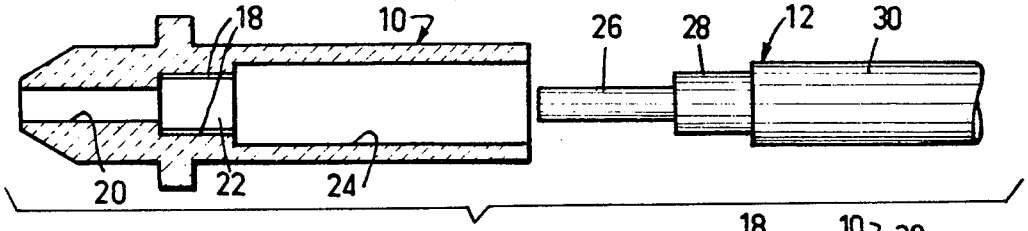
FIG.3
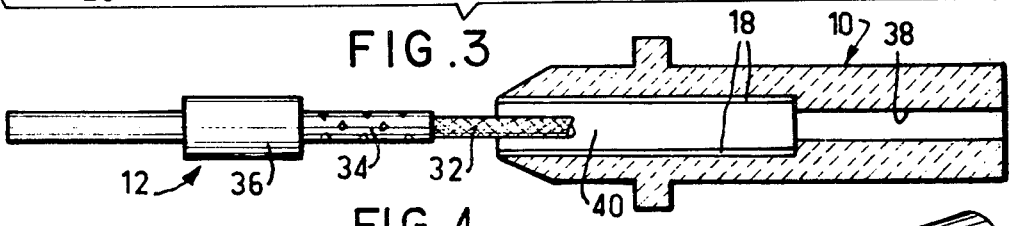
FIG.4
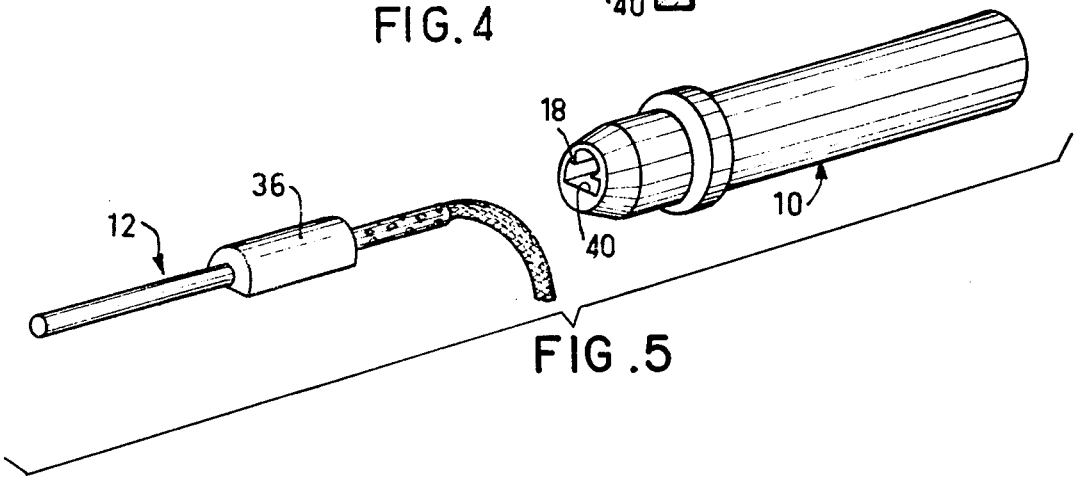
FIG.5

IGNITING ELECTRODES AND METHOD FOR MAKING SAME

The present invention relates to igniting electrodes for burners, and a method of manufacturing same.

Igniting electrodes are used for lighting burners for domestic or industrial use and cause ignition of the either gaseous or liquid fuel by means of an electrical spark.

The conventional methods of manufacturing igniting electrodes consist of fixing a metal stem in an insulating body, either by mechanical means, such as screwcutting of the metal and tapping of the body, or by cementing of the metal stem into a bore of the insulating material, or by a combination of both methods.

The object of the present invention is to provide a method of manufacturing such electrodes, easily and at a lower cost price than conventional methods.

According to a first aspect of the present invention there is provided a method of manufacturing an igniting electrode for a burner comprising the steps of providing an insulating body of a ceramic material, which body defines a longitudinal bore therethrough and the interior of which is provided over at least part of its length with projections or teeth, and forcing an electrically conducting metal stem of complementary shape to the longitudinal bore absent the projections or teeth into the bore of the insulating body so that the projections or teeth make an imprint in the surface of the metal stem as it is being inserted into the bore.

Conventionally, it has not been considered appropriate to impose force on a ceramic material and the electrode has always been introduced gently into the ceramic material, and then fixed in position by any suitable material. However, the forcing of the electrode is found to be very effective in guaranteeing locking of the stem in the insulating body against both longitudinal and rotational movement. Such locking is achieved when the stem is forced into the bore and does not require the stem to be either glued or cemented or mechanically fixed in position. The assembly of the electrodes is thus facilitated and results in a product with a cost price which is considerably lower than that of similar products manufactured by conventional methods.

Preferably the insulating body and the projections are formed by isostatic pressing.

The method according to the invention also makes it possible to use, if necessary, a raw drawn wire, which has not been subjected to any machining as a metal stem to guarantee its anchorage in the insulating body.

According to a second aspect of the present invention there is provided an igniting electrode for a burner manufactured according to the first aspect of the present invention and comprising an insulating body which defines a longitudinal bore therethrough and which is made from a ceramic material and an electrically conducting metal stem which carries the electrical current for generating an igniting spark, the bore of the insulating body being provided with projections or teeth which grip the stem, by making grooves in the metal of the stem, when the latter is forced into the said bore.

Preferably, the projections or teeth are provided on the walls of a non-cylindrical bore, and the metal stem has a shape which is complementary to that of the bore when stripped of its projections.

In this embodiment, the locking of the stem in the bore prevents any rotation, the projections embedding themselves in the stem and the cross sectional shapes of the stem and the bore also helping to prevent rotation. The cross section of the stem or wire can be specified to the supplier who can manufacture the stem by preliminary wire drawing.

Preferably also, the bore in the insulating body is axial and has sections of different diameters, the projections or teeth being formed on one of the aforesaid sections of the bore.

Preferably also, the respective diameters of the sections of the bore decrease from one end of the insulating body to the other, and the metal stem comprises section length and diameter which respectively correspond to those of the bores of the insulating body.

Preferably also, the stem has serrations or knurling on the section which engages with the projections or teeth of the insulating body.

Preferably also, the insulating body has a bore with three sections of different diameter, the intermediate section having a smaller diameter than either of the end sections of the bore and being provided with projections or teeth, and the metal stem consists of a central section of diameter and length which are respectively less than and greater than those of the intermediate section of the bore so that when the stem is in position in the bore, it is locked against movement in a longitudinal direction but not rotational movement, the central section being connected on one side to a first section of greater diameter than the intermediate section of the bore and, on the other side, to a second section of diameter at its greatest equal to that of the intermediate section of the bore, and a collar of diameter greater than that of the intermediate section of the bore with the teeth being formed between the central section and the second terminal section of the stem.

Hence, when a high axial resistance is required and rotation of the stem does not have to be prevented, the central section of the metal stem can have a smaller diameter than that of the intermediate section of the bore, so that the projections do not grip the stem.

If the stem is to be prevented from rotating, a flat portion is formed on the stem whose purpose is to fit inside a diametrical slit provided at the end of the insulating body.

Several embodiments of the invention will now be described by way of example with reference to the accompanying drawings in which:

FIGS. 1 and 1A are a perspective and an end view respectively of the insulating body, with FIG. 1 also showing part of an electrode, according to a first embodiment of the invention;

FIG. 2 is an axial cross section of the insulating body as shown in FIG. 1;

FIG. 3 is an axial cross section of the insulating body and a view of the stem of an electrode according to a second embodiment of the invention;

FIGS. 4 to 6 are a cross sectional, a perspective and a cross sectional view respectively of three other embodiments of the invention;

Figure 6:
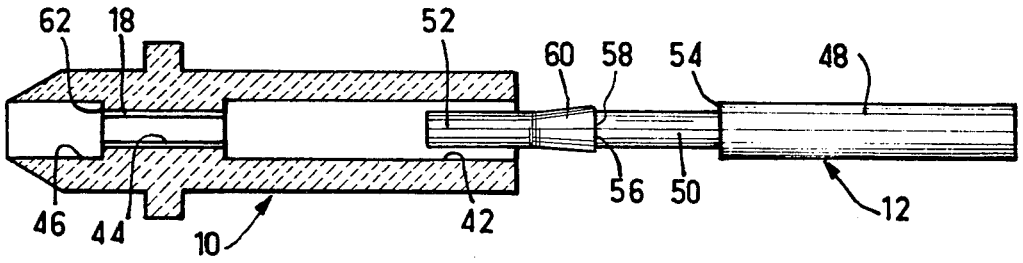

Throughout the specification and in the drawings the insulating body will be designated by reference 10, and the stem by the reference 12. The insulating body 10 is made of a ceramic material such as steatite, alumina or porcelain.

With reference to FIGS. 1, 1A and 2, the insulating body 10 is ceramic and has an axial bore 14 which terminates at one end of the insulating body 10 in a bore 16 of reduced diameter, the bore 16 being provided with axial projections or teeth 18. The insulating body 10 can be manufactured by isostatic pressing, which makes it possible to obtain axial bores 14 and 16 of different diameter with the projections 18 being formed only in the bore 16. It is also possible to manufacture the insulating body 10 by extrusion, but then the axial bore is of constant diameter and the projections extend from one end to the other of the insulating body. The projections are then removed from part of the bore by a second operation.

The stem 12 is made of metal and has a diameter complementary to that of the bore 16. The stem 12 is introduced into the insulating body 10 at the end of the bore 14 and is then forced into the bore 16 in such a manner that the teeth 18 grip the surface of the metal so that the stem is then locked and can be moved neither longitudinally nor rotationally in the insulation body 10.

Referring to the embodiment of FIG. 3, the teeth 18 are not visible from the outside of the insulating body 10 as they are formed on the intermediate portion of an axial bore with three portions, 20, 22 and 24 of different diameters. Provided that the three portions 20, 22 and 24 are of successively decreasing diameters from one end of the bore to the other, the insulating body 10 can be made by isostatic pressing.

The metal stem 12 consists of three sections 26, 28 and 30 of diameters which are approximately complementary to the three bore portions 20, 22 and 24. The central section 28 is of a length approximately equal to that of the bore portion 22. The stem 12 is forced from the portion 24 of the bore of the insulating body 10 until the shoulders defined at the junction between the sections of different diameter 26, 28 and 30 meet the shoulders formed at the junction between the portions 20, 22 and 24 of the bore. The stem is then also locked against rotation owing to the teeth 18.

Referring to the embodiment of FIG. 4, a flexible conducting wire 32, which carries the electrical current to the electrode, is set into a tubular end 34 of the metal stem 12. The said tubular end 34 adjoins a central section 36 of greater diameter. The insulating body 10 has an axial bore 38 which is wide enough to allow the conducting wire 32 and the tubular portion 34 to pass through freely, and a bore 40 of diameter approximately equal to that of the section 36 of the stem, which bore 40 is provided with longitudinal projections 18.

To assemble the electrode, the metal stem 12 which has been previously provided with the conducting wire 32, is introduced into the end of the bore 40, and forced inwards in such a manner that the teeth 18 become embedded in the section 36.

To improve the locking of the metal stem 12 in the insulating body 10 against rotation, the portion of the bore 40 provided with teeth 18, can have a non-circular cross section, for example a D-shaped cross section, as shown in FIG. 5, or alternatively an oval or polygonal cross section. Similarly, the central section 36 of the stem which is gripped by the teeth 18, can be provided with a complementary section to that of the bore 40. When in position, the stem 12 is prevented from rotating both by the action of the teeth 18 and by the combined effect of the section 36 and the bore 40.

Figure 6A:
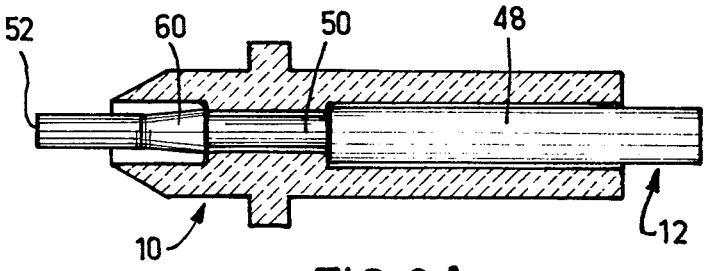
FIG. 6A is a cross section of the electrode shown in FIG. 6 but with the stem in position, and, FIG. 7 is a cross section of a modification of the electrode shown in FIG. 6.

Referring to FIGS. 6 and 6A, the insulating body 10 consists of a tiered bore, in which the central section 44 of the bore has a smaller diameter than those of the extreme ends 42 and 46 of the bore and is provided with longitudinal projections 18. The sections 42 and 44 of the bore are formed by isostatic pressing, whilst the section 46 of the bore is obtained by a second moulding operation because of the requirement for an undercut in the bore. The stem 12 consists of three sections 48, 50 and 52, the first section 48 has a complementary diameter to that of the section 42 of the bore and the two subsequent sections 50 and 52 have diameters which are less than that of the section 44 of the bore. The length of the section 50 is slightly greater than that of the section 44 of the bore. Between the first and second sections 48 and 50 is an annular shoulder 54, whilst between the second and third sections 50 and 52 is a collar 56 of greater diameter than that of the section 50. The collar 56 itself has a shoulder 58 opposing the shoulder 54 and its side 60, which is conical, adjoins the section 52.

To assemble the electrode, the end 52 of the stem 12 is introduced into the section 42 of the bore of the insulating body 10, the collar 56 being forced to pass through the portion 44 of the central bore until it is in position abutting the shoulder 62 defined by the ends of teeth 18 at the junction of portions 46 and 44 of the bore. The metal stem 12 is then locked against longitudinal movement by the combined action of shoulder 54 and 58 with those defined between the portions of the bore of the insulating body 10. Once in position, the stem 12 can, however, rotate freely. In other words, if rotation of the stem 12 is to be allowed, the section 50 can be provided with smaller diameter than that of the section 44 of the bore, so that the stem 12 is not gripped by the teeth 18. In this embodiment the diameter of collar 56 is only slightly greater than the diameter defined by the teeth 18, such that the teeth will scratch or deform the collar 56 only slightly as it passes through bore 44. Bore 44, absent the teeth 18, has a diameter at least as large as collar 56 such that only the teeth 18, and not bore 44, causes any deformation of collar 56.

Figure 7:
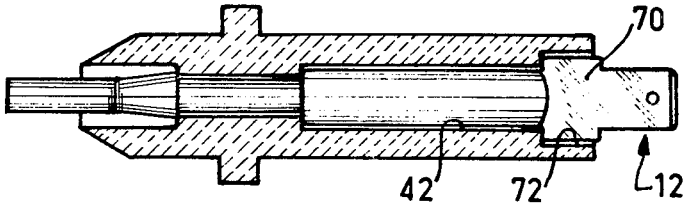

Rotation of the stem 12 within the insulating body 10 is prevented in a further embodiment as shown in FIG. 7. The electrode is substantially identical to that described above with reference to FIGS. 6 and 6A, the only difference being that the stem 12 has a flat part 70, which, once the stem is in position, fits into a diametrical slot 72 formed at the end of the portion 42 of the axial bore in the insulating body.

What is claimed is:

1. A method of manufacturing an igniting electrode for a burner comprising the steps of providing an insulating body of a ceramic material, which body defines a longitudinal bore therethrough and the interior of which is provided over at least part of its length with projections or teeth, providing an electrically conducting metal electrode stem means for supplying an electrical current to generate an igniting spark at an ignition end of the igniting electrode, said electrode stem means having a complementary shape to that of the longitudinal bore, absent said projections or teeth, and forcing said electrically conducting metal stem into the bore of the insulating body so that the projections or teeth make an imprint in the surface of the metal stem as it is being inserted into the bore.

2. A method as claimed in claim 1, in which the insulating body and the projections or teeth are formed by isostatic pressing.

3. A method as claimed in claim 2, in which the insulating body is additionally subjected to a second moulding operation to add an undercut in the bore.

4. An igniting electrode for a burner, comprising an insulating body made from a ceramic material, which defines a longitudinal bore therethrough the interior of which is provided over at least part of its length with projections or teeth and an electrically conducting metal electrode stem means for supplying an electrical current to generate an igniting spark at an ignition end of the igniting electrode, said electrically conducting metal stem being forced into the bore of the insulating body so that the projections or teeth make an imprint in the surface of the metal stem when the latter is forced into said bore.

5. An igniting electrode for a burner as claimed in claim 4, in which the projections or teeth are provided on the walls of a non-cylindrical bore and the metal stem has a shape which is complementary to that of the bore when stripped of its projections or teeth.

6. An igniting electrode for a burner as claimed in claim 4, in which the bore in the insulating body is axial and has sections of different diameters, the projections or teeth being formed on one of the aforesaid sections of the bore.

7. An igniting electrode for a burner as claimed in claim 6, in which the respective diameters of the sections of the bore decrease from one end of the insulating body to the other, and the metal stem comprises sections of length and diameter which respectively correspond to those of the bore of the insulating body.

8. An igniting electrode for a burner as claimed in claim 6, said longitudinal bore through the insulating body having a diameter at the ignition end of the igniting electrode which is greater than the diameter of the metal stem at said ignition end.

9. An igniting electrode for a burner as claimed in claim 4, in which the stem has serrations or knurling on the section which engages with the projections or teeth of the insulating body.

10. An igniting electrode for a burner as claimed in claim 4, in which the insulating body has a bore with three sections of different diameter, the intermediate section having a smaller diameter than either of the end sections of the bore and being provided with projections or teeth, and the metal stem consists of a central section of diameter and length which are respectively less than and greater than those of the intermediate section of the bore, the central section being connected, on one side, to a first section of greater diameter than the intermediate section of the bore, and, on the other side, to a second section of diameter at its greatest equal to that of the intermediate section of the bore, and a collar of diameter greater than that of the diameter defined by the teeth in the intermediate section of the bore being formed between the central section and the second terminal section of the stem such that when the stem is in position in the bore it is locked against movement in a longitudinal direction but not against rotational movement.

11. An igniting electrode for a burner as claimed in claim 10, in which the stem has a flat portion, and at one end of the insulating body a diametrical slot is provided to accommodate the said flat portion to prevent the stem from rotating.

12. An igniting electrode for a burner as claimed in claim 10, said longitudinal bore through the insulating body having a diameter at the ignition end of the igniting electrode which is greater than the diameter of the metal stem at said ignition end.

13. An igniting electrode for a burner as claimed in claim 4, said longitudinal bore through the insulating body having a diameter at the ignition end of the igniting electrode which is greater than the diameter of the metal stem at said ignition end.

* * * * *